United States Patent [19]

Maule

[11] Patent Number: 4,462,497

[45] Date of Patent: Jul. 31, 1984

[54] DISPLAY STAND

[76] Inventor: Warren E. Maule, 345 Ford Ave., Highland Park, Mich. 48203

[21] Appl. No.: 315,014

[22] Filed: Oct. 26, 1981

[51] Int. Cl.[3] ..... A47F 5/04

[52] U.S. Cl. ..... 211/7; 211/59.1; 211/60 T

[58] Field of Search ..... 211/7, 4, 40, 60 T, 211/57.1, 59.1, 24, 205

[56] References Cited

U.S. PATENT DOCUMENTS

| | | | |
|---|---|---|---|
| 920,132 | 5/1909 | Greener | 211/57.1 |
| 1,043,952 | 11/1912 | McKinney et al. | 211/59.1 |
| 1,856,239 | 5/1932 | Buckley | 211/4 |
| 3,315,819 | 4/1967 | Kingsbery | 211/13 X |
| 3,524,616 | 8/1970 | Marschak | 211/205 X |
| 3,982,633 | 9/1976 | Pennington | 211/4 |
| 4,254,879 | 3/1981 | Maule | 211/4 |
| 4,260,063 | 4/1981 | Bennett et al. | 211/4 |

FOREIGN PATENT DOCUMENTS

| | | | |
|---|---|---|---|
| 2446094 | 9/1980 | France | 211/7 |

*Primary Examiner*—Ramon S. Britts
*Assistant Examiner*—Robert W. Gibson, Jr.
*Attorney, Agent, or Firm*—Gifford, Van Ophem, Sheridan, Sprinkle & Nabozny

[57] ABSTRACT

A display stand for merchandise is provided and comprises an elongated upright support which is secured to a ground surface so that the support extends genrally vertically. At least one and perferably several locking assemblies are secured to and extend horizontally outwardly from the upright support. Each locking assembly comprises a pair of elongated rods, each having one end secured to the upright support so that the rods extend horizontally outwardly from the support and are parallel to each other. A cross member is pivotally secured to the free end of one rod while the other end of the cross member can be locked to the free end of the other rod to prevent unauthorized removal of merchandise from the stand.

13 Claims, 3 Drawing Figures

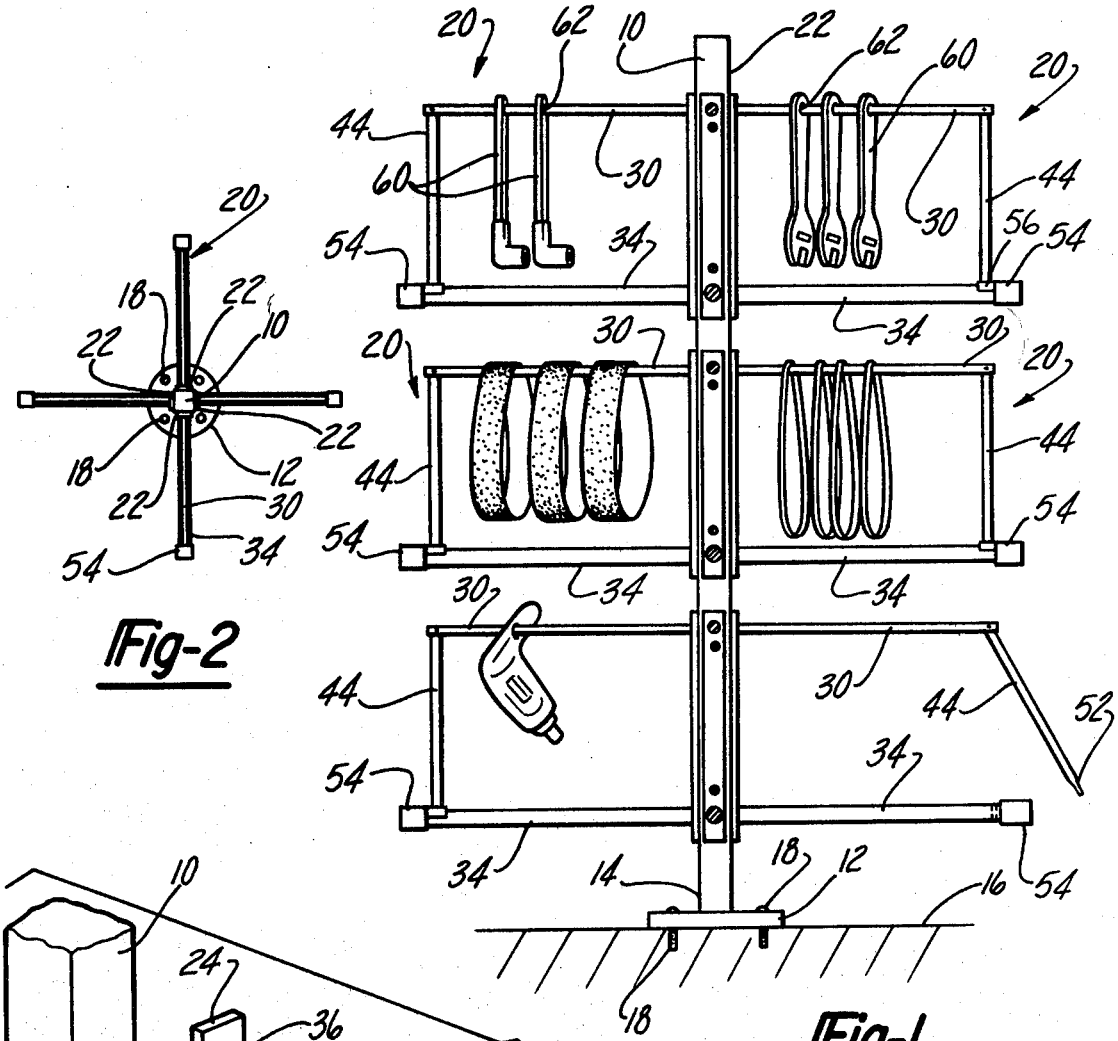
Fig-1
Fig-2
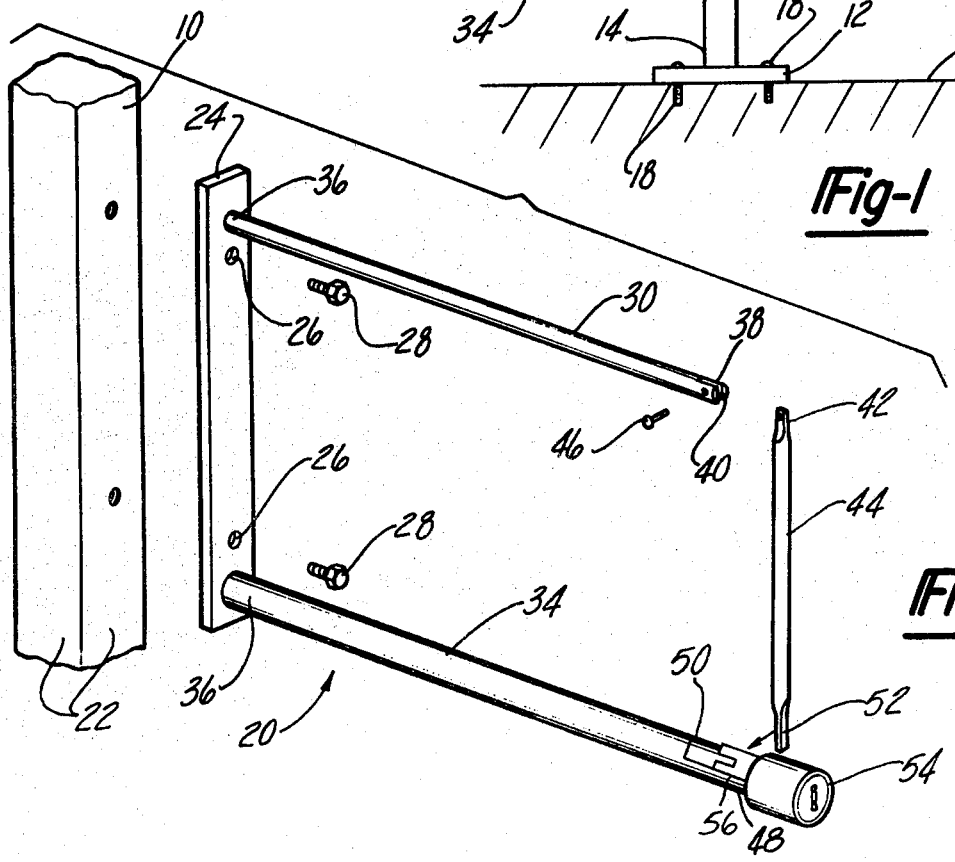
Fig-3

DISPLAY STAND

BACKGROUND OF THE INVENTION

I. Field of the Invention

The present invention relates to a stand for displaying merchandise and with means to prevent the unauthorized removal or merchandise from the stand.

II. Description of the Prior Art

In stores and shops which sell merchandise, it is necessary for the store owner to display the merchandise within the store to his perspective customers. Such merchandise, however, is frequently stolen by shoplifters. Although there have been a number of previously known devices designed to display merchandise and yet prevent its unauthorized removal, these previously known devices are awkward to use, expensive to obtain, and, therefore, have not enjoyed wide spread acceptance.

SUMMARY OF THE PRESENT INVENTION

The present invention provides a display stand which overcomes the above-mentioned disadvantages of the previously known devices.

In brief, the display stand according to the present invention comprises an elongated upright support and means for mounting the support to a ground surface so that the support extends generally vertically.

At least one, and preferably a plurality of locking assemblies are secured to the support for both holding and displaying merchandise. Each locking assembly comprises a pair of elongated rods secured to the upright support so that the rods extend horizontally and are generally parallel to and spaced apart from each other.

A cross member is pivotally secured to the free end of one rod while locking means secure the other end of the cross member to the free end of the rod. In the preferred form of the invention, the locking means includes a key operated lock to secure the cross member to the free end of the other rod to prevent the unauthorized removal of items mounted on the rods.

Although the display stand according to the present invention can be advantageously used for displaying merchandise in stores, alternatively, the display stand of the present invention can be used to secure personal possessions, such as tools, against theft in the persons home, garage or the like.

BRIEF DESCRIPTION OF THE DRAWING

A better understanding of the present invention will be had upon reference to the following detailed description when read in conjunction with the accompanying drawing, wherein like reference characters refer to like views throughout the several views, and in which:

FIG. 1 is a side view illustrating a preferred embodiment of the present invention;

FIG. 2 is a top view illustrating a preferred embodiment of the present invention; and FIG. 3 is an exploded fragmentary view illustrating a portion of the preferred embodiment of the invention.

DETAILED DESCRIPTION OF A PREFERRED EMBODIMENT OF THE PRESENT INVENTION

With reference to the drawing, a preferred embodiment of the display stand according to the present invention is thereshown and comprises an elongated, upright support 10. The upright support 10 is generally square in cross sectional shape and has a base 12 secured to its lower end 14. Thus, with the base 12 supported on a ground support surface 16, the upright support 10 extends generally vertically. Preferably, the base 12 is secured to the ground support surface 16 by bolts or screws 18 so that the upright support 10 is fixed against movement.

With reference particularly to FIGS. 1 and 3, a plurality of locking assemblies 20 are secured to the upright support 10 so that the locking assemblies 20 extend outwardly from the upright support 10. In addition, as best shown in FIGS. 1 and 2, a plurality of vertically spaced locking assemblies 20 are secured to each side 22 of the upright support 10 in a fashion to be subsequently described.

Each locking assembly 20 comprises an elongated rectangular plate 24 having a width less than the width of the side 22 of the upright support 10. A pair of spaced holes 26 are formed through the plate 24 while threaded fasteners 28 extend through the holes 26 and engage the upright support 10 to secure the plate 24 to the upright support 10. With the plate 24 secured to the upright support 10, the longitudinal axis of the plate 24 extends generally vertically and thus parallel to the axis of the support 10.

With reference now particularly to FIG. 3, a first elongated rod 30 is secured by any conventional means adjacent the top of the plate 24 so that the rod 30 extends perpendicularly outwardly from the plate 24. Similarly, a second rod 34 is secured at one end 36 by any conventional means adjacent the lower end of the plate 24. The rod 34 also extends perpendicularly outwardly from the plate 24 and thus parallel to but spaced from the first rod 30. With the plate 24 secured to the upright support 10 by the fasteners 28, the rods 30 and 34 extend generally horizontally.

Still referring particularly to FIG. 3, the outer or free end 38 of the first rod 30 includes a vertically extending slot 40 formed in it. One end 42 of an elongated cross member 44 is dimensioned to fit within the slot 40 and, after doing so, a pin 46 pivotally secures the first rod 30 and cross member 44 together. The cross member 44 is thus pivotal between a position in which the cross member 44 is aligned with the first rod 30 and to a second position in which the cross member extends perpendicularly downwardly from the first rod 30.

Still referring to FIG. 3, the outer or free end 48 of the second rod 34 also includes a vertically extending slot 50 formed in it. In addition, the other end 52 of the cross member 44 is flattened and fits within the slot 50 when the cross member 44 is in its second position.

A key operated cylinder 54 is attached or enclosed within the free end 48 of the second rod. The cylinder 54 includes a detent 56 which, upon operation by the key to the locking position, traps the end 52 of the cross member 44 within the slot 50. Thus, the cylinder 54 is operable to hold the cross member 44 in its second position, i.e., perpendicular to the upper rod 30.

With reference now particularly to FIG. 1, the preferred embodiment of the display stand of the present invention is thereshown displaying a plurality of items 60. Each item 60 has an opening 62 formed through it and the items 60 are positioned on the display stand so that the upper rod 30 extends through these openings 62. In order to insert the rod 30 through the opening 62, the cross member 44 is first pivoted outwardly so that it is aligned with the upper rod 30, and the items 62 are then simply slid over the cross member 44 and onto the rod 30.

After the items 60 have been positioned on the first rod 30 in the above-described fashion, the cross member is pivoted downwardly to its second or downwardly extending position and the cylinder 54 is then locked to secure the cross bar 44 to the free end 48 of the lower or second rod 34 as best shown in FIG. 1. Upon doing so, the items 60 are locked to the display stand against unauthorized removal. Instead, the authorized removal of item 60 from the display stand requires a special key, combination or other device which is available only to a person authorized to remove the items 60 from the display stand.

From the foregoing, it can be seen that the display stand according to the present invention provides a simple, inexpensive and yet totally effective means for displaying merchandise while simultaneously preventing the unauthorized removal of the merchandise from the display stand. Furthermore, the provision of a plurality of locking assemblies 20 which are both vertically and angularly spaced around the upright support 10 enables a plurality of diverse items to be displayed on a single display stand.

Alternatively, the display stand according to the present invention can be used by private individuals to protect their possessions against theft in their home, garage, or the like in their absence from the home, as well as in industrial and commercial applications.

Having described my invention, however, many modifications thereto will become apparent to those skilled in the art to which it pertains without deviation from the spirit of the invention as defined by the scope of the appended claims.

I claim:

1. A display stand comprising:

an elongated support and means for mounting said support to a ground surface so that said support extends generally vertically, at least one locking assembly secured to said support, each locking assembly comprising:

a first elongated rod, said first rod having one end secured to said support so that said first rod extends substantially horizontally outwardly from said support, a second elongated rod, said second rod having one end secured to said support so that said second rod extends substantially horizontally outwardly from said support in a spaced and substantially parallel relationship to said first rod, an elongated cross member rod pivotally secured at one end to the other end of one of said first and second rods, means for lockably securing the other end of the cross member rod to the other end of the other of said first and second rods against unauthorized access, wherein said other end of said other of said first and second rods includes an axially extending recess, said other end of said cross member rod having a portion receivable within said recess, and wherein said lockable securing means comprises means for closing said recess with said cross member portion positioned within said recess.

2. The invention as defined in claim 1 wherein said closing means comprises a lock cylinder attached to said other end of said other rod.

3. The invention as defined in claim 2 wherein said cylinder includes a key operated lock.

4. The invention as defined in claim 1 wherein said one end of each of said first and second rods is secured to an elongated plate and means for securing said plate to said support.

5. The invention as defined in claim 1 and comprising a plurality of locking assemblies secured to said support.

6. The invention as defined in claim 5 wherein said locking assemblies are vertically spaced from each other.

7. The invention as defined in claim 5 wherein said locking assemblies are horizontally aligned and angularly spaced from each other.

8. The invention as defined in claim 5 wherein said support is substantially square in cross sectional shape thus having four vertically extending sides, and at least one locking assembly secured to each side of said support.

9. The invention as defined in claim 8 and comprising at least two vertically spaced locking assemblies secured to each side of said support.

10. A display stand comprising:

an elongated support and means for mounting said support to a ground surface so that said support extends generally vertically, at least one locking assembly secured to said support, each locking assembly comprising:

a first elongated rod, said first rod having one end secured to said support so that said first rod extends substantially horizontally outwardly from said support, a second elongated rod, said second rod having one end secured to said support so that said second rod extends substantially horizontally outwardly from said support in a spaced and substantially parallel relationship to said first rod, an elongated cross member and means for pivotally securing one end of said cross member to the other end of one of said rods so that the other end of said cross member pivots outwardly away from the other ends of said first and second rods and the space intermediate said first and second rods within the plane defined through the axes of said parallel first and second rods, means for lockably securing the other end of the cross member to the other end of the other rod against unauthorized access.

11. The invention as defined in claim 10 wherein said cross member is an elongated rod.

12. The invention as defined in claim 10 wherein said other end of said other rod includes an axially extending recess, said other end of said cross member having a portion receivable within said recess, and wherein said lockable securing means comprises means for closing said recess with said cross member portion positioned within said recess.

13. A display stand comprising:

an elongated support and means for mounting said support to a ground surface so that said support extends generally vertically, at least one locking assembly secured to said support, each locking assembly comprising:

a first elongated rod, said first rod having one end secured to said support so that said first rod extends substantially horizontally outwardly from said support, a second elongated rod, said second rod having one end secured to said support so that said second rod extends substantially horizontally outwardly from said support in a spaced and substantially parallel relationship to said first rod, an elongated cross member and means for pivotally securing one end of said cross member to the other end of one of said rods so that the other end of said cross member pivots outwardly away from the other ends of said first and second rods and the space intermediate said first and second rods, means for lockably securing the other end of the cross member to the other end of the other rod against unauthorized access, wherein said other end of said other rod includes an axially extending recess, said other end of said cross member having a portion receivable within said recess, and wherein said lockable securing means comprises means for closing said recess with said cross member portion positioned within said recess.

* * * * *

UNITED STATES PATENT AND TRADEMARK OFFICE

CERTIFICATE OF CORRECTION

PATENT NO. : 4,462,497

DATED : July 31, 1984

INVENTOR(S) : Warren E. Maule

It is certified that error appears in the above—identified patent and that said Letters Patent is hereby corrected as shown below:

Column 1, line 47 delete "persons'" insert --person's--.

Signed and Sealed this

*Thirtieth* Day of *July 1985*

[SEAL]

*Attest:*

DONALD J. QUIGG

*Attesting Officer* *Acting Commissioner of Patents and Trademarks*